US010030898B2

(12) United States Patent
Zhang et al.

(10) Patent No.: US 10,030,898 B2
(45) Date of Patent: Jul. 24, 2018

(54) OIL BALANCING APPARATUS AND REFRIGERATION SYSTEM WITH OIL BALANCING APPARATUS

(71) Applicant: Danfoss (Tianjin) Ltd., Tianjin (CN)

(72) Inventors: Leping Zhang, Tianjin (CN); Patrice Bonnefoi, Tianjin (CN); Serdar Suindykov, Tianjin (CN)

(73) Assignee: DANFOSS (TIANJIN) LTD. (CN)

( * ) Notice: Subject to any disclaimer, the term of this patent is extended or adjusted under 35 U.S.C. 154(b) by 700 days.

(21) Appl. No.: 14/134,007

(22) Filed: Dec. 19, 2013

(65) Prior Publication Data

US 2015/0044070 A1 Feb. 12, 2015

(30) Foreign Application Priority Data

Dec. 31, 2012 (CN) ..... 2012 1 0594800

(51) Int. Cl.
*F25B 43/02* (2006.01)
*F25B 31/00* (2006.01)
*F25B 6/02* (2006.01)

(52) U.S. Cl.
CPC ..... *F25B 31/002* (2013.01); *F25B 31/004* (2013.01); *F25B 6/02* (2013.01); *F25B 2400/075* (2013.01); *F25B 2500/16* (2013.01); *F25B 2600/025* (2013.01)

(58) Field of Classification Search
CPC ..... F25B 31/002; F25B 31/004; F25B 43/02; F25B 2500/16
USPC ..... 62/192, 193, 468, 470, 471, 84
See application file for complete search history.

(56) References Cited

U.S. PATENT DOCUMENTS 4,895,498 A * 1/1990 Basseggio ..... F04B 39/0207 184/103.1
5,634,345 A * 6/1997 Alsenz ..... F04B 39/0207 184/7.4
2005/0066684 A1* 3/2005 Matsuoka ..... F04B 39/02 62/470
2005/0072183 A1* 4/2005 Takashi ..... F04B 39/0207 62/468
2005/0092000 A1* 5/2005 Hwang ..... F25B 31/004 62/193
2005/0229627 A1* 10/2005 De Bernardi ..... F25B 31/002 62/468

* cited by examiner

*Primary Examiner* — Ned Landrum
*Assistant Examiner* — Daniel C Comings
(74) *Attorney, Agent, or Firm* — Carlson, Gaskey & Olds, P.C.

(57) ABSTRACT

An oil balancing apparatus is for use with a first compressor and at least two second compressors. Suction pipes of the first compressor and the second compressors are connected in parallel to a suction main pipe and discharge pipes of the first compressor and the second compressors are connected in parallel to a discharge main pipe. The first compressor is in an operating state, and the second compressors are operated intermittently. The oil balancing apparatus includes a first oil balancing pipe connecting oil sumps of the second compressors in series, and a second oil balancing pipe connecting an oil sump of the first compressor to a bottom of the first oil balancing pipe. A refrigeration system is also disclosed.

22 Claims, 4 Drawing Sheets

OIL BALANCING APPARATUS AND REFRIGERATION SYSTEM WITH OIL BALANCING APPARATUS

CROSS-REFERENCE TO RELATED APPLICATION

This application claims priority of Chinese Patent Application No. 201210594800.1, filed on Dec. 31, 2012. The disclosure of the above application is incorporated herein by reference.

FIELD OF THE INVENTION

The present invention relates to the field of refrigeration and air conditioning, and more particularly to an oil balancing apparatus and a refrigeration system using the oil balancing apparatus.

BACKGROUND

A refrigeration system sometimes needs to use multiple compressors at the same time. For example, the manifolding of compressors is being used in the air conditioning and refrigeration industry more and more frequently. Compressors connected in parallel have advantages such as convenience in energy modulation, convenience in maintenance of a single shutdown compressor, and low cost. Lubrication oil is indispensable during running of the compressors. However, due to different displacements and different piping designs between the multiple compressors, a compressor, especially a scroll compressor with a low-pressure chamber, may be damaged due to the lack of lubrication oil.

Therefore, it is necessary to manage oil levels of multiple compressors. In conventional oil level management, an active oil return apparatus is used in the refrigeration industry. However, the active oil return apparatus is not as applicable to commercial or light commercial air conditioning due to its high cost and complex system structure.

Alternatively, the oil level may also be managed by way of piping design, but this cannot effectively control the oil level of a compressor. Therefore, the conventional oil level management cannot meet requirements for both low cost and high reliability.

A conventional refrigeration system is widely used in an air conditioning device for cooling and heating indoor air and used in other refrigeration machines. A compressor group in the conventional refrigeration system includes multiple compressors. One of the multiple compressors is a "first" compressor. The first compressor may be a compressor with modulated capacity (or with variable displacement) or may be a fixed capacity compressor. To enable the refrigeration system to be operated in a partial load mode, others of the multiple compressors are "second" compressors connected in parallel. The second compressors can work intermittently according to load demands. When capacity requirement is precise, the first compressor further has a capacity adjustment (variable capacity) capability. In order to increase the precision of reaching the required capacity, the first compressor further has an ability to modulate capacity according to a request.

Specifically, in a conventional refrigeration system, there are several methods for balancing lubrication oil among the first compressor and the second compressors. To balance oil among a plurality of compressors, a method depends on an oil balancing pipe among compressors. Another method depends on an oil separator at a discharge pipe. However, none of the conventional methods can provide a reliable oil balancing solution in a partial load condition. If no oil balancing pipe is provided for a refrigeration system, a compressor having a small capacity tends to be short of oil. In a refrigeration system without an oil balancing pipe, a compressor having a larger capacity may reach an oil-starvation state faster.

Currently, an oil balancing pipe is provided in a conventional compressor group. The oil balancing pipe is connected in parallel or in series to an oil sump of a compressor. In some solutions, an additional gas balancing pipe is installed among the compressors, so as to reduce a pressure difference between compressors caused by different refrigerant flows.

In a conventional compressor group, when compressors are operated with different capacities, an oil return pipe and an oil balancing pipe for the compressors cannot solve the oil balancing problem in a partial load mode. It has been proven in practice that in some conditions (e.g., there is a large pressure difference between different compressors due to different compressor capacities), oil may be sucked from a compressor having a higher pressure and enter a compressor having a lower pressure. In addition, a gas balancing pipe may be helpful to reduce a pressure difference. However, the use of the gas balancing pipe requires changes to the structure of a compressor and requires more piping connections and welding work, resulting in a complex system.

Therefore, there is no reliable and economic oil balancing solution in the conventional art.

SUMMARY

In view of the foregoing, a first aspect of the present invention provides an oil balancing apparatus for compressors. The compressors include a first compressor and at least two second compressors. Suction pipes of the first compressor and the second compressors are connected in parallel to a suction main pipe, whereas discharge pipes of the first compressor and the second compressors are connected in parallel to a discharge main pipe. During operation of a system with the oil balancing apparatus, the first compressor is kept in an operating state, and the second compressors are operated intermittently. The oil balancing apparatus includes:

a first oil balancing pipe, adapted to connect oil sumps of the second compressors in series, and a second oil balancing pipe, adapted to connect an oil sump of the first compressor with a bottom of the first oil balancing pipe.

A second aspect of the present invention provides a refrigeration system. The refrigeration system includes multiple compressors connected in parallel, and the above-mentioned oil balancing apparatus between the multiple compressors.

In an embodiment of the present invention, the second oil balancing pipe of the first compressor is connected to the bottom of a common oil balancing pipe between the second compressors. Thereby, the oil sump of the first compressor is not directly connected with oil sumps of the second compressors. Consequently, among the first compressor and the second compressors, an oil amount required by a compressor having a lower pressure can be transported into an oil sump of a compressor having a lower pressure. Thus, an oil level in the compressor having a lower pressure can be guaranteed, and oil balancing is more reliable and economic.

BRIEF DESCRIPTION OF THE DRAWINGS

Advantages of the present invention will become clearer and more comprehensible through the following descriptions of embodiment with reference to the accompanying drawings, where.

DETAILED DESCRIPTION

Figure 1:
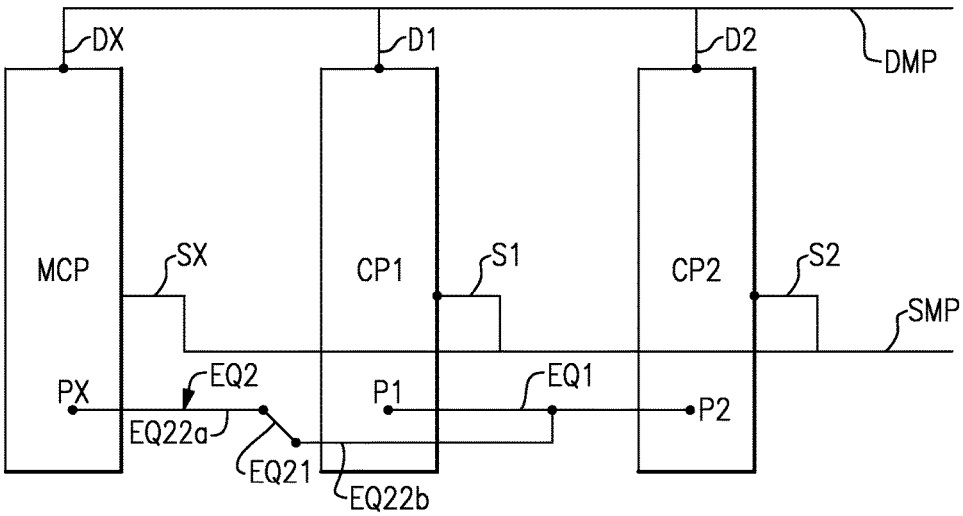
FIG. 1 is a schematic diagram of oil balancing apparatus among three compressors according to a first embodiment of the present invention.

The technical solutions of the present invention are further illustrated below in detail in embodiments with reference to the accompanying drawings. In the description, the same or similar reference signs represent same or similar members. The following illustration of the implementation of the present invention with reference to the accompanying drawings should not be regarded as a limit to the scope of the present invention.

An embodiment of the present invention provides an oil balancing apparatus. The oil balancing apparatus is applicable to a refrigeration system with multiple compressors, and can guarantee rapid and reliable oil balancing between compressors. In the refrigeration system with multiple compressors, some of the multiple compressors may be short of oil, called oil-starved compressor while some of them may be rich in oil, called oil-rich compressor. The terms "oil-starved compressor" and "oil-rich compressor" are briefly described below.

An oil-starved compressor refers to a compressor in which an oil amount is smaller than a standard oil amount for running the compressor or a compressor in which an oil amount is smaller than an oil amount in other associated compressors. An oil-rich compressor refers to a compressor in which an oil amount is larger than a standard oil amount for running the compressor, or a compressor in which an oil amount is relatively larger than an oil amount in other associated compressors. In a practical multi-compressor system, the oil-starved compressor and the oil-rich compressor may exist due to a practical running condition, or may be intentionally designed by a designer. For example, by designing different oil levels, different orders of oil supply or different oil consumption for the compressors in the system, oil in one or more compressors in the system is consumed to a level lower than a standard oil level/height before an oil level in the other compressors reaches a low level. The one or more compressors are oil-starved compressors. Compressors with an oil level higher than a standard oil level/height are oil-rich compressors. In the present application, the term "oil" may be lubrication oil required by running of the compressors.

In an embodiment of the present invention, a compressor group in a refrigeration system includes several compressors. These compressors are connected in parallel. One of the compressors in parallel is a first compressor that is always running, and the rest of the compressors in parallel run intermittently. An embodiment of the present invention is to improve the design of an oil balancing pipe, in order to eliminate situations in which oil is pumped from the compressor with modulated capacity to the set of fixed capacity compressors or vice versa, i.e., to prevent situations in which oil is directly pumped from the first compressor to the second compressor or oil is directly pumped from the second compressors to the first compressor. The design change includes a connection of the oil equalization pipe provided to the compressor with modulated capacity in such a manner that it is connected to the bottom part of a common oil equalization pipe between compressors with fixed capacity. By doing this a direct connection of the compressor with modulated capacity to the sump of compressors with fixed capacity is eliminated, letting only a limited amount of oil to be transferred into the volume with lower pressure.

In an embodiment of the present invention, an oil balancing pipe of a first compressor is designed to be connected to the bottom of a common oil balancing pipe between the second compressors. Thereby, a direct connection is avoided between an oil sump of the first compressor and oil sumps of the second compressors. An oil amount required by a compressor having a lower pressure among the first compressor and the second compressors can be transported into an oil sump of the compressor having the lower pressure.

First Embodiment

Referring to FIG. 1, a compressor group in this embodiment of the present invention includes three compressors. One of the three compressors is a first compressor (or a master compressor (MCP)), the rest of the three compressors are second compressors (or slave compressors) CP1 and CP2. As shown in FIG. 1, the first compressor MCP and the second compressors CP1 and CP2 are connected in parallel to a suction main pipe SMP respectively through respective suction pipes SX, S1 and S2. Respective discharge pipes DX, D1 and D2 of the first compressor MCP and the second compressors CP1 and CP2 are connected in parallel to a discharge main pipe DMP respectively. Thereby, the first compressor MCP and the second compressors CP1 and CP2 are connected in parallel in the refrigeration system.

In this embodiment, oil sumps (not showed in the drawings) of the second compressors CP1 and CP2 are connected through a first oil balancing pipe EQ1. Generally, the first oil balancing pipe EQ1 is made as a horizontal pipe. An oil sump (not shown in the drawing) of the first compressor MCP is connected to the bottom (vertically lower portion) of the first oil balancing pipe EQ1 through a second oil balancing pipe EQ2. The second oil balancing pipe EQ2 is designed in a shape to be connectable to the bottom of the first oil balancing pipe EQ1. According to an embodiment of the present application, the second oil balancing pipe EQ2 may be in any shape as long as the second oil balancing pipe EQ2 implements the foregoing function.

In the embodiment, the oil sumps of the second compressors CP1 and CP2 are connected by the first oil balancing pipe EQ1. An oil sump of the first compressor MCP is connected to the first oil balancing pipe EQ1 by a second oil balancing pipe EQ2. The shape of the pipe EQ2 is made in such a manner to be able to connect to the bottom part of the pipe EQ1. By doing this, it can insure a layer of oil covering the inlet of the pipe, which creates a hydraulic seal preventing the gas from entering the pipe EQ2, improving the efficiency of oil transportation of oil balancing pipe (or, oil equalization pipe). The pipe EQ1 equalizes the oil between compressors CP1 and CP2 as well as balancing minor pressure difference through the gas layer over the oil. The first compressor MCP may be working at a higher capacity than the second compressors CP1 and CP2. Then the pressure inside the shell of the first compressor MCP will be lower than in the second compressors CP1 and CP2. The oil starts to migrate from the pipe EQ1 to the first compressor MCP through the pipe EQ2. Once the oil in the second compressors CP1 and CP2 reaches the bottom of the pipe EQ1, no more oil can be transferred to the first compressor MCP, because the pipe EQ2 does not have direct connection to their sumps. Therefore the minimum level of oil is maintained.

In case the first compressor MCP is working at a capacity lower than the second compressors CP1 and CP2, the oil will migrate in another direction—from the first compressor MCP. When the oil reaches the bottom of the pipe EQ2, the oil will not move from below the pipe because the gas flow will be dampen by resistance of the oil layer over the pipe connection to EQ1. Therefore the minimum level in the first compressor MCP will be maintained as well.

As shown in FIG. 1, two ends of the first oil balancing pipe EQ1 are connected respectively to the oil sumps of the second compressors CP1 and CP2 at positions P1 and P2. The positions P1 and P2 are basically at the same height level, and are at a suitable position higher than respective bottoms of the oil sumps of the second compressors CP1 and CP2. In addition, one end of the second oil balancing pipe EQ2 is connected to the oil sump of the first compressor MCP at a position PX. The position PX is at a height approximately equal to the height of the positions P1 and P2. It can be known from the above that, a person skilled in the art can set the height of the positions PX, P1 and P2 according to requirements and specific applications. In this embodiment, positions at which the suction pipes S1 and S2 and the suction pipe SX are connected to their corresponding compressors CP1, CP2 and MCP are at the same height level with each other. In an embodiment, connecting positions and connecting height of a suction pipe and a discharge pipe can be selected according to practical requirements.

It should be noted that in an embodiment of the present invention, the oil sumps of the compressors CP1, CP2, and MCP are at the bottom of the respective compressors.

In an embodiment of the present invention, the diameter of the second oil balancing pipe EQ2 is smaller than or equal to the diameter of the first oil balancing pipe EQ1.

To facilitate control of multiple compressors connected in parallel, multiple second compressors connected in parallel have an approximately equal or equivalent capacity, but are not limited thereto. When a capacity difference between the second compressors CP1 and CP2 is big, a flow limiting ring (not shown) may be provided at a suction port of the compressor with the lower capacity to balance a suction pressure difference between the second compressors. There is no limitation to the capacity of the first compressor MCP.

According to an embodiment, a person skilled in the art can set, according to requirements, the first compressor and the second compressors as follows: (1) the first compressor is a compressor with a modulated capacity, and the second compressors are compressors with a fixed capacity; (2) the first compressor is a compressor with a fixed capacity, and the second compressors are also compressors with a modulated capacity; or (3) the first compressor is a compressor with a modulated capacity, and the second compressors are also compressors with a modulated capacity. According to requirements, the foregoing structural arrangement can be changed to enable better operation of each compressor.

As can be seen from FIG. 1, in the first embodiment, the shape of the second oil balancing pipe EQ2 may be: two ends thereof are approximately horizontal pipe sections EQ22*a*, EQ22*b*, spaced apart by a middle pipe section EQ21, which is a bent or slope pipe connecting the two horizontal pipe sections EQ22*a*, EQ22*b*. The design of the middle pipe section EQ21 can enable one end of the second oil balancing pipe EQ2 via the horizontal pipe EQ22*b* to be connected at the bottom of the first oil balancing pipe EQ1.

In an embodiment of the present invention, the oil balancing apparatus having the first oil balancing pipe EQ1 and the second oil balancing pipe EQ2 can reduce the transfer of a refrigerant gas through an oil balancing pipe among the first compressor and the second compressors, thereby improving the oil transport efficiency of the first and/or second oil balancing pipes EQ1/EQ2. The first oil balancing pipe EQ1 can balance an oil level and a pressure of an oil sump between the second compressors CP1 and CP2.

If the first compressor MCP works at a higher capacity than the second compressor CP1 or CP2, the pressure inside the shell of the first compressor MCP is lower than the pressure inside the shells of the second compressors CP1 and CP2. Oil can be transferred from the first oil balancing pipe EQ1 to the first compressor MCP through the second oil balancing pipe EQ2. Once the oil level in the second compressors CP1 and CP2 is lower than or equal to the height of the bottom of the first oil balancing pipe EQ1, oil is no longer transferred into the first compressor MCP because the second oil balancing pipe EQ2 is not directly connected to the oil sumps of the second compressors CP1 and CP2. Therefore, the minimum oil level in the oil sumps of the second compressors CP1 and CP2 can be ensured.

If the first compressor MCP works at a lower capacity than the second compressors CP1 and CP2, oil is transferred from the first compressor MCP to the second compressors CP1 and CP2. When the oil level inside the first compressor MCP is lower than or equal to the bottom of a pipe port PX where the second oil balancing pipe EQ2 is connected to the oil sump of the first compressor MCP, oil is no longer transferred from the first compressor MCP to the first oil balancing pipe EQ1. Therefore, the minimum oil level of the oil sump of the first compressor MCP can also be ensured.

As can be seen from the foregoing analysis, the oil balancing solution provided in the first embodiment of the present invention achieves oil balancing among compressors and guarantees the lowest oil level of each compressor.

Second Embodiment

Figure 2:
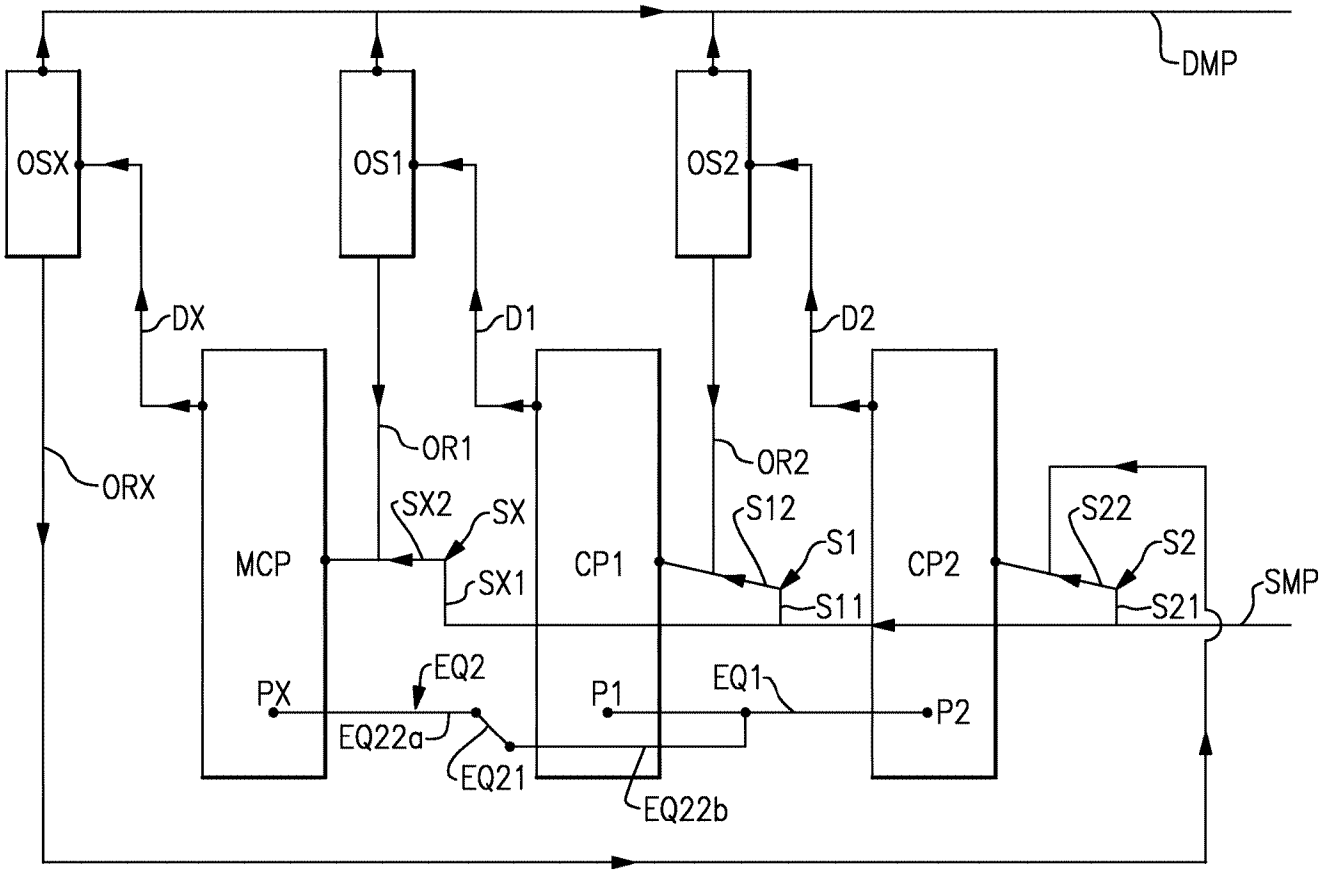
FIG. 2 is a schematic diagram of a configuration having an oil separator and a suction pipe for supplying oil to a compressor according to a second embodiment of the present invention.

FIG. 2 shows a solution of a piping connection configuration which includes an oil separator, a pipe connected to the oil separator, and a suction pipe supplying oil separated by the oil separator to another compressor.

As shown in FIG. 2, in the second embodiment of the present invention, three compressors, a first compressor MCP and second compressors CP1 and CP2, are also connected in parallel to a suction main pipe SMP and a discharge main pipe DMP, respectively. Configuration of an oil balancing apparatus between the oil sumps of the three compressors (i.e., the first oil balancing pipe and the second oil balancing pipes EQ1 and EQ2) is similar to that in the first embodiment, and will not be described in detail herein. However, a difference from the first embodiment is that the second embodiment further includes three oil separators.

Each oil separator is to achieve oil separation for a compressor and is to transfer separated oil to a next compressor connected to the separator.

The three oil separators OS1, OS2, and OSX and relevant arrangements thereof are illustrated below in detail.

Referring to FIG. 2, the suction pipes S1 and S2 include vertical pipe sections S11 and S21 and upward slope sections S12 and S22 connected to the vertical pipe sections S11 and S21 respectively. Gas is guided from a suction main pipe SMP through the vertical pipe sections S11 and S21 and flows through respective slope sections S12 and S22 to be sucked into corresponding compressors CP1 and CP2. The suction pipe SX includes a vertical pipe section SX1, and a horizontal pipe section SX2 connected to the vertical pipe section SX1. The gas is guided from the suction main pipe SMP through the vertical pipe section SX1, and is sucked into the first compressor MCP which is a variable capacity compressor is this embodiment through the horizontal pipe section SX2.

Specifically, a discharge pipe D1 of the second compressor CP1 is connected to a corresponding oil separator OS1 thereof. The oil separator OS1 separates oil from the gas discharged by the second compressor CP1, transfers the separated oil to the horizontal pipe section SX2 of the suction pipe of the first compressor MCP through the oil return pipe OR1, and discharges the separated gas through the discharge main pipe DMP. Subsequently, the first compressor MCP sucks in the gas from the suction main pipe SMP and the oil from the oil return pipe OR1 through the horizontal pipe section SX2. The oil from the oil return pipe OR1 drops into the oil sump of the first compressor MCP due to gravity. Therefore, the oil separated from the gas discharged from the second compressor CP1 can be transferred into the first compressor MCP.

Similarly, a discharge pipe DX of the first compressor MCP is connected to a corresponding oil separator OSX thereof. The oil separator OSX separates oil carried in the gas discharged from the first compressor MCP, transfers the oil to the slope pipe section S22 of the suction pipe S2 of the second compressor CP2 through the oil return pipe ORX, and discharges the separated gas into the discharge main pipe DMP. Subsequently, the second compressor CP2 sucks in the gas from the suction main pipe SMP and the returned oil through the slope pipe section S22. The returned oil drops into the oil sump of the second compressor CP2 due to gravity.

Similarly, a discharge pipe D2 of the second compressor CP2 is connected to a corresponding oil separator OS2 thereof. The oil separator OS2 separates oil carried in the gas discharged from the second compressor CP2, transfers the oil to the slope pipe section S12 of the suction pipe S1 of the second compressor CP1 through the oil return pipe OR2, and discharges the separated gas to the discharge main pipe DMP. Subsequently, the second compressor CP1 sucks in the gas from the suction main pipe SMP and the returned oil through the slope pipe section S12, and the returned oil drops into the oil sump of the second compressor CP1 due to gravity.

In such a configuration, the oil can be transferred from a compressor to another compressor by way of oil cross-feeding implemented by the oil separators OS1, OS2 and OSX. In an embodiment of the present invention, the suction pipes of the second compressors CP1 and CP2 are configured with slope pipe sections S12, S22. The slope pipe sections can achieve great advantages, especially, when a second compressor stops working. The slope pipe section of each of the second compressors CP1, CP2 can guide returned oil into the vertical pipe section S11, S21 of the suction pipe S1, S2 due to gravity, and returns the oil to the suction main pipe SMP. Therefore, oil in the suction main pipe SMP can be transferred to a next compressor that is working. According to an embodiment, a slope suction pipe section is not configured for the first compressor MCP as the first compressor MCP is always being operated. In embodiments of the present invention, the oil balancing pipe can improve efficiency of oil balancing, e.g., can realize oil balancing between compressors more rapidly.

Third Embodiment

Figure 3:
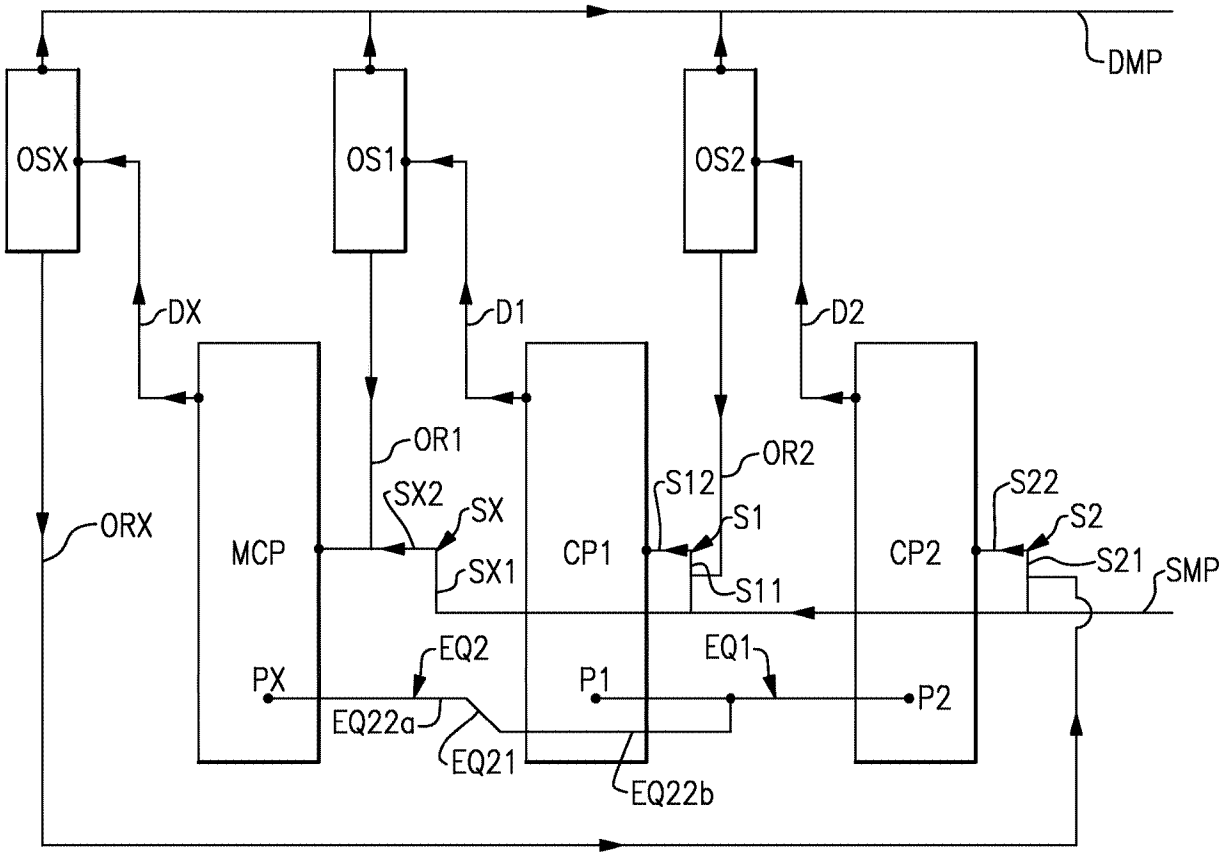
FIG. 3 is a schematic diagram of another example of a configuration of an oil return pipe and the suction pipe shown in FIG. 2 according to a third embodiment of the present invention.

FIG. 3 shows another example of a configuration of an oil return pipe and the suction pipe shown in FIG. 2 according to a third embodiment of the present invention.

What is different from the configuration in FIG. 2 is the connection manner of oil return pipes from oil separators OS1, OS2 and OSX and the structures of corresponding suction pipes. However, oil cross-feeding and oil returning to a suction main pipe also make use of gravity.

As shown in FIG. 3, in the third embodiment of the present invention, three compressors, for example, a first compressor MCP and two second compressors CP1 and CP2 are connected in parallel to a suction main pipe SMP and a discharge main pipe DMP respectively. Oil balancing apparatus for the oil sumps of the three compressors (i.e., the first oil balancing pipe EQ1 and the second oil balancing pipes EQ2) is similar to the oil balancing apparatus in the first embodiment, and will not be described in detail in the third embodiment. Compared with the second embodiment, the third embodiment has different arrangement and connection manners for the oil return pipe and the suction pipe.

The arrangement for the oil return pipe and the suction pipe will be described below in detail.

Referring to FIG. 3, the suction pipes S1 and S2 include vertical pipe sections S11 and S21 respectively and horizontal pipe sections S12 and S22 respectively. The pipe sections S11 and S21 are respectively in connection with the pipe sections S12 and S22. Gas is guided from the suction main pipe SMP through the vertical pipe sections S11 and S21, and is sucked into the corresponding second compressors CP1 and CP2 through respective horizontal pipe sections S12 and S22. The suction pipe SX includes a vertical pipe section SX1 and a horizontal pipe section SX2. The vertical pipe section SX1 is in connection with the horizontal pipe section SX2. The gas is guided from the suction main pipe SMP through the vertical pipe section SX1, and is sucked into the first compressor MCP through the horizontal pipe section SX2.

In an example, a discharge pipe D1 of the second compressor CP1 is connected to a corresponding oil separator OS1 thereof. The oil separator OS1 separates oil from the gas discharged from the second compressor CP1, transfers the separated oil to the horizontal pipe section SX2 of the suction pipe SX of the first compressor MCP through an oil return pipe OR1, and discharges the separated gas through the discharge main pipe DMP. Subsequently, the first compressor MCP sucks in the gas from the suction main pipe SMP and the oil from the oil return pipe OR1 through the horizontal pipe section SX2. The returned oil drops into the oil sump of the first compressor MCP due to gravity. Thereby, the oil carried in the gas discharged from the second compressor CP1 can be separated and transferred to the first compressor MCP.

Similarly, a discharge pipe DX of the first compressor MCP is connected to a corresponding oil separator OSX thereof. The oil separator OSX separates oil carried in the gas discharged by the first compressor MCP, transfers the oil to the vertical pipe section S21 of the suction pipe S2 of the second compressor CP2 through the oil return pipe ORX, and discharges the gas after separation processing to the discharge main pipe DMP. The second compressor CP2 sucks in the oil in the vertical pipe section S21 and the gas from the suction main pipe SMP through the horizontal pipe section S22.

A discharge pipe D2 of the second compressor CP2 is connected to a corresponding oil separator OS2 thereof. The oil separator OS2 separates oil carried in the gas discharged by the second compressor CP2, transfers the oil to the vertical pipe section S11 of the suction pipe S1 of the second compressor CP1 through an oil return pipe OR2, and discharges the gas after separation processing to the discharge main pipe DMP. The second compressor CP1 sucks in the oil in the vertical pipe section S11 and the gas from the suction main pipe SMP through the horizontal pipe section S12.

As can be seen from the foregoing, the respective horizontal pipe sections S12 and S22 of the suction pipes S1 and S2 can enable the return of the separated oil to the suction pipes of the second compressors CP1 and CP2. When the compressor is started, the gas flow moves gas carrying oil into a corresponding compressor, otherwise oil is transferred to respective vertical pipe sections S11 and S21 and drops in the suction main pipe SMP due to gravity. In this embodiment, the oil return pipe OR1 for the oil separator OS1 is connected to the horizontal pipe section SX2 of the suction pipe SX for the first compressor MCP as the first compressor MCP is always being operated.

The two solutions in the second embodiment and the third embodiment can allow the second compressors CP1 and CP2 to start in different sequences.

Fourth Embodiment

Figure 4:
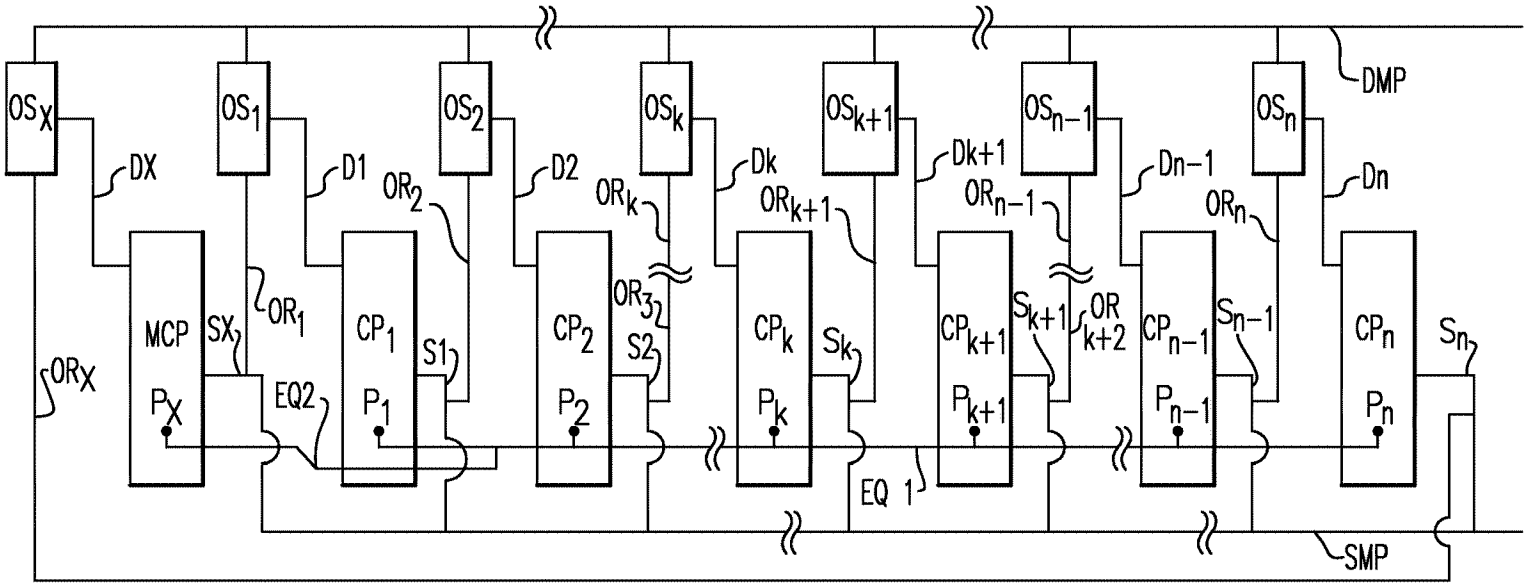
FIG. 4 is a schematic diagram of a configuration of a refrigeration system comprising n quantity of second compressors and one first compressor according to a fourth embodiment of the present invention.

FIG. 4 shows a configuration having n (n representing integer) second compressors and 1 first compressor.

Embodiments in FIG. 4 and FIG. 3 are similar in terms of connection structures and principles, and are different in the number of second compressors. The connection structures and the principles will not be described in detail again, and only the differences are illustrated in detail.

Specifically, a first oil balancing pipe EQ1 is connected in series to respective oil sumps of n second compressors CP1, CP2, . . . , CPk, CPk+1, . . . , CPn−1, and CPn, where n and k are both integers.

In addition, similar to the third embodiment, n oil separators OS1, OS2, . . . , OSk, OSk+1, . . . , OSn−1, and OSn, n discharge pipes D1, D2, . . . , Dk, Dk+1, . . . , Dn−1, and Dn, n oil return pipes OR1, OR2, . . . , ORk, ORk+1, . . . , ORn−1, and ORn, and n suction pipes S1, S2, . . . , Sk, Sk+1, . . . , Sn−1, and Sn are configured, where k and n are integers.

According to embodiments of the present invention, the first compressor will keep being operated, the oil balancing apparatus includes a first oil balancing pipe between second compressors and a second oil balancing pipe between a first compressor and the bottom of the first oil balancing pipe, and thereby reliable oil distribution can be achieved among compressors no matter which of the second compressor is operated or turned off. In addition, the piping connection is simple and no additional components or extra changes are required for a compressor shell. Therefore, the solution according to the embodiments of the present invention has a lower cost.

It should be noted that: the foregoing specific embodiments are described by an example of two second compressors and one first compressor, but a person skilled in the art should understand that the present invention is not limited to the foregoing cases and is also applicable to cases with more compressors, such as 3, 4, 5, 6 or more. Also, the first compressor may be a fixed capacity compressor, or may also be a modulated capacity compressor with a capacity adjustment function. The second compressors may be variable capacity compressors or fixed capacity compressors.

In the foregoing specific embodiments of the present invention, the first compressor and the second compressors may be low-pressure cavity scroll compressors. However, the present invention is not limited thereto. The present invention is also applicable to oil balancing among compressors of other types.

According to an embodiment of the present invention, a refrigeration system is also provided.

Although some embodiments of the general concept of the present invention have been shown and illustrated, a person skilled in the art shall understand that variations made to these embodiments without departing from the principle and spirit of the general inventive concept shall fall within the scope of the present invention as specified in the claims and equivalents thereof.

The invention claimed is:

1. A refrigeration system, comprising:

multiple compressors connected in parallel, wherein the compressors comprises a first compressor and at least two second compressors, suction pipes of the first compressor and the second compressors connected in parallel to a suction main pipe, discharge pipes of the first compressor and the second compressors connected in parallel to a discharge main pipe, the first compressor being kept operated, and the second compressors operated intermittently; and an oil balancing apparatus between the multiple compressors, the oil balancing apparatus including a first oil balancing pipe, adapted to connect oil sumps of the second compressors in series, and a second oil balancing pipe, adapted to connect an oil sump of the first compressor with a bottom of the first oil balancing pipe such that a length of the second oil balancing pipe branches substantially downward from the bottom of the first oil balancing pipe.

2. The refrigeration system according to claim 1, wherein, a first connecting position at which the second oil balancing pipe is connected to the oil sump of the first compressor is higher than a bottom of the oil sump of the first compressor.

3. The refrigeration system according to claim 2, wherein, a second connecting position at which the first oil balancing pipe is connected to a second compressor is at an approximately the same height as the first connecting position.

4. The refrigeration system according to claim 3, wherein, a diameter of the second oil balancing pipe is smaller than or equal to a diameter of the first oil balancing pipe.

5. The refrigeration system according to claim 4, further comprising:

an oil separator configured for each compressor of the first compressor and the second compressors and arranged between a discharge pipe of said each compressor and a suction pipe of another compressor, said discharge pipe connecting the oil separator to the discharge main pipe, a pipe adapted to connect the oil separator and said each compressor, an oil return pipe adapted to transfer oil separated by the oil separator to the suction pipe of said another compressor.

6. The refrigeration system according to claim 5, wherein, a suction pipe of each second compressor comprises a vertical pipe section connected to the suction main pipe and an upward slope pipe section connecting the vertical pipe section and an oil sump of said each second compressor; wherein an oil return pipe of another second compressor or an oil return pipe of the first compressor is connected to the suction pipe of said each second compressor at the upward slope pipe section of the suction pipe of said each second compressor.

7. The refrigeration system according to 5, wherein, a suction pipe of each second compressor comprises a vertical pipe section connected to the suction main pipe and a horizontal pipe section connecting the vertical pipe section and an oil sump of said each second compressor; wherein an oil return pipe of another second compressor or an oil return pipe of the first compressor is connected to the suction pipe of said each second compressor at the vertical pipe section of the suction pipe of said each second compressor.

8. The refrigeration system of claim 5, wherein, the first compressor is a modulated capacity compressor, and each of the second compressors is a fixed capacity compressor; or the first compressor is a fixed capacity compressor, and each of the second compressors is a fixed capacity compressor; or the first compressor is a modulated capacity compressor, and each of the second compressors is a modulated capacity compressor.

9. The refrigeration system according to claim 3, further comprising:

an oil separator configured for each compressor of the first compressor and the second compressors and arranged between a discharge pipe of said each compressor and a suction pipe of another compressor, said discharge pipe connecting the oil separator to the discharge main pipe, a pipe adapted to connect the oil separator and said each compressor, an oil return pipe adapted to transfer oil separated by the oil separator to the suction pipe of said another compressor.

10. The refrigeration system according to claim 9, wherein, a suction pipe of each said second compressor comprises a vertical pipe section connected to the suction main pipe and an upward slope pipe section connecting the vertical pipe section and an oil sump of said each second compressor, wherein an oil return pipe of another second compressor or an oil return pipe of the first compressor is connected to the suction pipe of said each second compressor at the upward slope pipe section of the suction pipe of said each second compressor.

11. The refrigeration system according to claim 9, wherein, a suction pipe of each second compressor comprises a vertical pipe section connected to the suction main pipe and a horizontal pipe section connecting the vertical pipe section and an oil sump of said each second compressor, wherein an oil return pipe of another second compressor or an oil return pipe of the first compressor is connected to the suction pipe of said each second compressor at the vertical pipe section of the suction pipe of said each second compressor.

12. The refrigeration system according to claim 9, wherein, the first compressor is a modulated capacity compressor, and each of the second compressors is a fixed capacity compressor; or the first compressor is a fixed capacity compressor, and each of the second compressors is a fixed capacity compressor; or the first compressor is a modulated capacity compressor, and each of the second compressors is a modulated capacity compressor.

13. The refrigeration system according to claim 1, wherein, the first oil balancing pipe is a horizontal pipe.

14. The refrigeration system according to claim 13, wherein the horizontal pipe spans between the second compressors such that the horizontal pipe is higher than a bottom of each of the oil sumps of the second compressors, and the second oil balancing pipe is connected to the bottom of the first oil balancing pipe at a location between ends of the horizontal pipe.

15. The refrigeration system according to claim 1, wherein, the second oil balancing pipe comprises one of at least one bent pipe section or at least one slope pipe section.

16. The refrigeration system according to claim 1, further comprising:

an oil separator configured for each compressor of the first compressor and the second compressors and arranged between a discharge pipe of each said compressor and a suction pipe of another compressor, said discharge pipe connecting the oil separator to the discharge main pipe, a pipe adapted to connect the oil separator and said each compressor, and an oil return pipe adapted to transfer oil separated by the oil separator to the suction pipe of said another compressor.

17. The refrigeration system according to claim 16, wherein, a suction pipe of each said second compressor comprises a vertical pipe section connected to the suction main pipe and an upward slope pipe section connecting the vertical pipe section and an oil sump of said each second compressor, wherein an oil return pipe of another second compressor or an oil return pipe of the first compressor is connected to the suction pipe of said each second compressor at the upward slope pipe section of the suction pipe of said each second compressor.

18. The refrigeration system according to claim 17, wherein each of the discharge pipes extends from a side of a corresponding one of the first compressor and the second compressors, each oil return pipe is coupled to one of the suction pipes at a location relatively higher than each of the first oil balancing pipe and the second oil balancing pipe, and the upward slope pipe section of the suction pipe of said each second compressor extends diagonally from the respective vertical pipe section.

19. The refrigeration system according to claim 16, wherein, a suction pipe of each second compressor comprises a vertical pipe section connected to the suction main pipe and a horizontal pipe section connecting the vertical pipe section and an oil sump of said each second compressor, wherein an oil return pipe of another second compressor or an oil return pipe of the first compressor is connected to the suction pipe of said each second compressor at the vertical pipe section of the suction pipe of said each second compressor.

20. The refrigeration system according to claim 16, wherein, the first compressor is a modulated capacity compressor, and each of the second compressors is a fixed capacity compressor; or the first compressor is a fixed capacity compressor, and each of the second compressors is a fixed capacity compressor; or the first compressor is a modulated capacity compressor, and each of the second compressors is a modulated capacity compressor.

21. The refrigeration system according to claim 1, wherein, a diameter of the second oil balancing pipe is smaller than or equal to diameter of the first oil balancing pipe.

22. The refrigeration system according to claim 1, wherein the second oil balancing pipe is connected to the bottom of the first oil balancing pipe at a location between ends of the first oil balancing pipe.

* * * * *